United States Patent [19]

Kaibara et al.

[11] 4,169,444

[45] Oct. 2, 1979

[54] FUEL INJECTION APPARATUS

[75] Inventors: Nobuhiro Kaibara; Yasutaka Yuzawa; Masayoshi Kobayashi, all of Matsuyama, Japan

[73] Assignee: Diesel Kiki Company, Ltd., Tokyo, Japan

[21] Appl. No.: 775,579

[22] Filed: Mar. 8, 1977

[30] Foreign Application Priority Data

Mar. 13, 1976 [JP] Japan ..... 51/30247[U]

[51] Int. Cl.[2] ..... F02M 39/00

[52] U.S. Cl. ..... 123/139 AQ

[58] Field of Search ..... 123/139 AP, 139 AQ; 417/252

[56] References Cited

U.S. PATENT DOCUMENTS

| | | | |
|---|---|---|---|
| 3,004,410 | 10/1961 | Pierce | 123/139 AQ X |
| 3,394,688 | 7/1968 | Roosa | 123/139 AQ |
| 3,906,916 | 9/1975 | Laufer | 123/139 AQ X |

FOREIGN PATENT DOCUMENTS

| | | | |
|---|---|---|---|
| 2458109 | 6/1975 | Fed. Rep. of Germany | 123/139 AQ |

*Primary Examiner*—Michael Koczo

*Attorney, Agent, or Firm*—David G. Alexander

[57] ABSTRACT

A fuel supply pump supplies fuel from a fuel reservoir to a fuel injection pump which comprises a piston for injecting fuel from a fuel injection nozzle into an internal combustion engine. The piston is reciprocated for fuel injection by an engine driven rotary cam. The fuel injection pump further comprises a fuel control sleeve which is positioned by flyweights to control the fuel injection volume in accordance with the engine speed. A modulator valve is actuated by the flyweights to control the supply pump pressure in accordance with engine speed. A fuel injection timing means is responsive to the modulated supply pump pressure to control the angular relationship between the engine crankshaft and the rotary cam and thereby the fuel injection timing in accordance with the modulated pressure.

7 Claims, 3 Drawing Figures

FUEL INJECTION APPARATUS

BACKGROUND OF THE INVENTION

The present invention relates to a fuel injection apparatus for an internal combustion engine.

In order to obtain optimum performance from a fuel injected internal combustion engine, the correct amount of fuel must be injected into the engine at the proper timing. Whereas in the past the emphasis has been on obtaining maximum production of mechanical power from internal combustion engines, due to the widespread pollution of the environment by automotive vehicles it has become increasingly necessary to concentrate on reducing the emission of pollutants from these vehicles.

Fuel injection pumps for Diesel engines are generally provided with governors which limit the engine speed to a predetermined maximum value. When the engine speed exceeds the maximum value the governor acts to sharply reduce the fuel injection volume and thereby reduce the engine speed below the maximum value. For the purpose of reducing pollutant emission, the fuel injection timing is retarded as the fuel injection volume is reduced. The retarded injection timing promotes more complete combustion due to elevated combustion temperature and thereby reduces the formation and emission of carbon monoxide and other pollutants which are products of incomplete combustion.

However, when the engine is operating under light load conditions, the amount of engine speed overshoot is greater than under heavy load conditions due to low inertia. Under such light load conditions, it is not desirable to retard the injection timing unconditionally since this results in the formation of nitrogen oxides. More specifically, due to the large engine speed overshoot the amount of fuel injected into the engine at high speed is extremely low. Although the resulting extremely high combustion temperature essentially eliminates the formation of carbon monoxide, it is so high that nitrogen oxides are formed. Thus, the desired effect of pollutant emission reduction is lost since unconditional retardation of injection timing merely results in the formation of a different pollutant.

SUMMARY OF THE INVENTION

In brief, a fuel injection apparatus embodying the present invention comprises a fuel supply pump which supplies fuel from a fuel reservoir to a fuel injection pump which comprises a piston for injecting fuel from a fuel injection nozzle into an internal combustion engine. The piston is reciprocated for fuel injection by an engine driven rotary cam. The injection pump further comprises a fuel control sleeve which is positioned by flyweights to control the fuel injection volume in accordance with the engine speed. A modulator valve is actuated by the flyweights to control the supply pump pressure in accordance with engine speed. A fuel injection timing means is responsive to the modulated supply pump pressure to control the angular relationship between the crankshaft and the rotary cam and thereby the fuel injection timing in accordance with the modulated pressure. The timing means is so constructed as to retard the injection timing when the engine speed exceeds a predetermined value by a certain amount and advance the injection timing when the engine speed further increases. The advanced timing prevents excessive combustion temperature thereby preventing the formation of nitrogen oxides at the high engine speed overshoot encountered under light load engine operation.

It is an object of the present invention to reduce the emission of pollutants from a fuel injected internal combustion engine.

It is another object of the present invention to provide a fuel injection apparatus comprising an injection timing means which maintains optimum injection timing for reduction of pollutant emission under all engine speed and load conditions.

It is another object of the present invention to provide a fuel injection apparatus in which the injection timing is optimally controlled in accordance with engine speed.

It is another object of the present invention to provide a generally improved fuel injection apparatus.

Other objects, together with the foregoing, are attained in the embodiment described in the following description and illustrated in the accompanying drawing.

DESCRIPTION OF THE PREFERRED EMBODIMENT

While the fuel injection apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
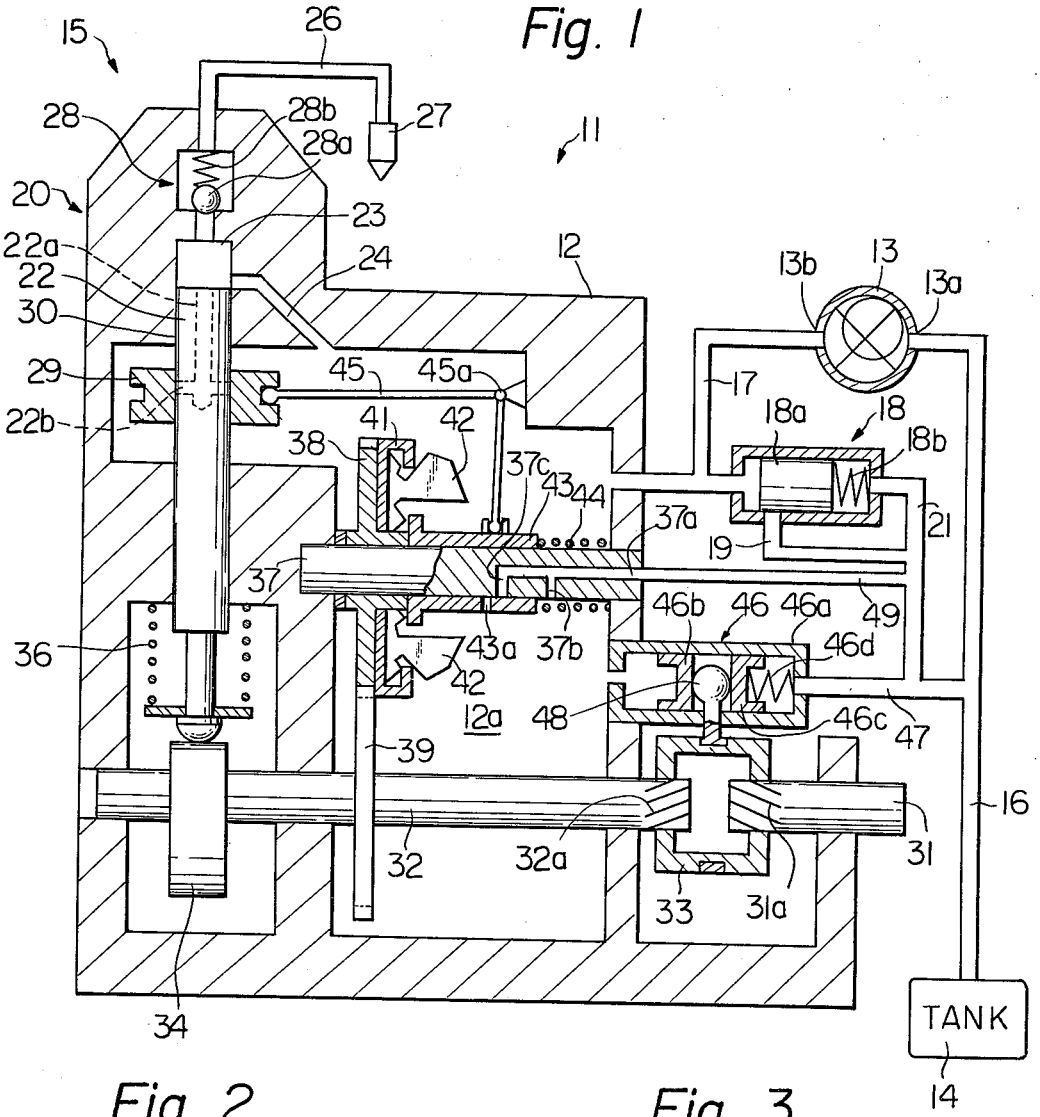
FIG. 1 is a schematic view of a fuel injection apparatus embodying the present invention at zero engine speed.

Referring now to FIG. 1 of the drawing, a fuel injection apparatus embodying the present invention is generally designated by the reference numeral 11 and comprises a housing 12. Whereas the fuel injection apparatus 11 is provided to inject fuel into the cylinder of an internal combustion which is typically of the combustion ignition or Diesel type, a fuel supply pump 13 is driven from the engine crankshaft to supply fuel under pressure into the interior of the housing 12 from a fuel reservoir or tank 14. The engine and associated components are not the subject matter of the present invention and are not shown.

More specifically, an inlet **13*a* of the fuel supply pump 13 is connected to the fuel tank 14 through a conduit 16. It will be assumed that the fuel pressure in the tank 14 and conduit 16 is substantially atmospheric. An outlet 13*b* of the fuel supply pump 13 is connected to an interior chamber 12*a* of the housing 12 through a conduit 17. Connected between the conduits 17 and 16 is a pressure regulator valve 18 which serves to bypass excess fuel from the conduit 17 to the conduit 16 to maintain the fuel pressure in the conduit 17 at a predetermined value. A piston 18*a* of the regulator valve 18 is urged leftwardly by a compression spring 18*b* to normally block the opening of a conduit 19 leading from the interior of the regulator valve 18 to the conduit 16**.

The left face of the piston 18*a* is exposed to the pressure in the conduit 17. When this pressure exceeds the predetermined value which corresponds to the preload of the spring 18*b*, the piston 18*a* is moved rightwardly by the pressure against the force of the spring 18*b* to uncover the opening of the conduit 19 and bypass fuel from the conduit 17 to the conduit 16 until the pressure in the conduit 17 is reduced to the predetermined value. The right end of the regulator valve 18 is connected to the conduit 16 through a conduit 21 to maintain the right end of the piston 18*a* at atmospheric pressure and return any fuel which leaks past the piston 18*a* to the tank 14. A fuel injection pump assembly 15 comprises a pump housing 20 constituted by part of the housing 12 in which is formed a bore 30.

Sealingly slidable in the bore 30 is a piston 22 formed with a longitudinal passageway 22*a* and a radial passageway 22*b* which leads from the longitudinal passageway 22*a*. The upper end of the longitudinal passageway 22*a* opens into a pressure chamber 23 defined by the bore 30 and the upper face of the piston 22. A passageway 24 leads from the interior chamber 12*a* into the pressure chamber 23 in a manner which will be described in detail below. A pressure passageway 26 leads from the pressure chamber 23 to a fuel injector nozzle orifice 27 which opens into the engine cylinder. Disposed in the pressure passageway 26 is a check valve 28 comprising a ball 28*a* and a compression spring 28*b* which urges the ball 28*a* to seat and block the passageway 26.

Slidingly and sealingly supported on the piston 22 is a fuel control valve or sleeve 29 which cooperates with the radial passageway 22*b* to control the fuel injection volume. A rotary input shaft 31 is driven from the engine crankshaft and is connected to a camshaft 32 by means of a coupler 33. A rotary cam 34 is fixed to the camshaft 32 which engages with the lower end of the piston 22. A compression spring 36 maintains the piston 22 in engagement with the cam 34. In operation, rotation of the cam 34 causes reciprocation of the piston 22 in such a manner as to inject fuel into the engine. With the piston 22 in its lowermost position as illustrated, fuel flows from the interior chamber 12*a* into the pressure chamber 23 through the passageway 24. As the piston 22 is moved upwardly by the cam 34, it covers the opening of the passageway 24 thereby trapping fuel in the pressure chamber 23. Further upward movement of the piston 22 increases the pressure in the pressure chamber 22 to the extent that it overcomes the preload of the spring 28*b* and unseats the ball 28*a*. With the check valve 28 opened thereby fuel is forced by the piston 22 through the pressure passageway 26 and nozzle orifice 27 into the engine cylinder. In other words, fuel is injected into the engine.

Further upward movement of the piston 22 causes the radial passageway 22*b* to be unblocked by the sleeve 29, communicating the pressure chamber 23 with the interior chamber 12*a* through the longitudinal passageway 22*a* and radial passageway 22*b*. This causes a rapid drop of pressure in the pressure chamber 23 which results in the ball 28*a* being seated by the spring 28*b* and the termination of fuel injection. After reaching its uppermost position, the piston 22 is moved downwardly by the spring 36 uncovering the opening of the passageway 24 and filling the pressure chamber 23 with fuel for a subsequent fuel injection operation.

Fixedly mounted in the interior chamber 12*a* is a shaft 37 about which is rotatably supported a gear 38. The gear 38 meshes with a gear 39 fixed to the camshaft 32 and is rotatably driven thereby. A flyweight support plate 41 is fixed to the gear 38 for integral rotation and pivotally supports flyweights 42. A sleeve 43 is urged leftwardly into engagement with the flyweights 42 by a governor spring 44 of the compression type. The sleeve 43 is connected to the sleeve 29 through a bellcrank lever 45 which is pivotal about a fulcrum 45*a*.

The flyweights 42 and associated components assume the positions illustrated in FIG. 1 when the engine speed is below a predetermined maximum value, with the apparatus 11 operating to prevent the engine speed from substantially exceeding the maximum value. For engine speeds from zero to the maximum value, the centrifugal force developed by the flyweights 42 is insufficient to overcome the preload of the governor spring 44. However, when the engine speed exceeds the maximum value, the sleeve 43 is moved progressively rightwardly by the flyweights 42 against the force of the spring 44. This causes the bellcrank lever 45 to pivot counterclockwise and move the sleeve 29 downwardly.

With the sleeve 29 moved downwardly from the position illustrated, less upward movement of the piston 22 is required from the lowermost position thereof for the radial passageway 22*b* to be unblocked by the sleeve 29 than when the sleeve 29 is in the illustrated position. Since the pressure chamber 23 is thereby connected to the interior chamber 12*a* at an earlier point in the fuel injection operation, a smaller volume of fuel is injected into the engine. Thus, as the engine speed exceeds the maximum predetermined value, the sleeve 29 is moved downwardly reducing the amount of fuel injection and reducing the engine speed below the maximum value. The greater the amount of engine speed overshoot above the maximum value, the greater the downward movement of the sleeve 29 and the smaller the amount of fuel injection.

As is visible in FIG. 1, the right end of the camshaft 32 and the left end of the input shaft 31 are formed with helical male splines 32*a* and 31*a* respectively. Although not visible in the drawing, the coupler 33 is formed with conjugate female splines. The splines 31*a* and 32*a* are formed in opposite directions so that longitudinal movement of the coupler 33 causes rotation of the camshaft 32 relative to the input shaft 31. In other words, the angular relationship between the shafts 31 and 32 is determined by the longitudinal position of the coupler 33.

A pressure piston unit 46 is mounted to the housing 12 and comprises a bored body 46*a* in which pistons 46*b* and 46*c* are sealingly slidable. The left face of the piston 46*b* is exposed to the fuel pressure in the interior chamber 12*a* and the right face of the piston 46*c* is exposed to atmospheric pressure through a conduit 47. An arm 48 is attached to the coupler 33 by a dovetail circumferential groove or similar means (no numerals) so that the arm 48 and coupler 33 are integrally connected together for longitudinal movement but the coupler 33 is free to rotate relative to the arm 48. A compression spring 46*d* urges the piston 46*c* into engagement with the arm 48 and thereby urges the arm 48 and coupler 33 leftwardly. In opposition, the fuel pressure in the interior chamber 12*a* urges the piston 46*b* rightwardly into engagement with the arm 48 and thereby urges the arm 48 and coupler 33 rightwardly.

The shaft 37 and sleeve 43 are formed with passageways as will be described in detail below so as to constitute a modulator valve (no numeral) for modulating the fuel pressure in the interior chamber 12*a*. The shaft 37 is formed with a longitudinal passageway 37*a* which communicates with the conduit 16 through a conduit 49. In addition, the shaft 37 is formed with first and second longitudinally spaced radial orifices or passageways 37*b* and 37*c* respectively which connect with the longitudinal passageway 37*a*. The sleeve 43 is formed with a hole 43*a* which is alignable with the radial passageway 37*c*.

Since the camshaft 32 is angularly positioned relative to the input shaft 31 depending on the longitudinal position of the coupler 33, the position of the coupler 33 determines the fuel injection timing. More specifically, since the input shaft 31 is driven from the engine crankshaft (not shown), the angular relationship between the camshaft 32 and the input shaft 31 determines the crankshaft position at which fuel will be injected into the engine. It will be assumed that leftward movement of the coupler 33 retards the injection timing and rightward movement of the coupler 33 advances the injection timing.

With the engine speed between zero and the maximum value, the flyweights 42 are in the illustrated position and the sleeve 43 assumes its leftmost position. In this case the radial passageway 37*b* is unblocked by the sleeve 43 but the radial passageway 37*c* is blocked by the sleeve 43. Thus, fuel is able to flow from the interior chamber 12*a* to the conduit 16 through the radial passageway 37*b*, longitudinal passageway 37*a* and conduit 49. This causes a reduction in the fuel pressure in the interior chamber 12*a* below the pressure at the outlet 13*b* of the supply pump 13 to a value which is dependent on the flow rate through the radial passageway 37*b*. The force of the spring 46*d* is selected so that at an equilibrium position of the arm 48 and coupler 33 determined by the fuel pressure in the interior chamber 12*a* and the force of the spring 46*d* the coupler 33 will assume a position such that the injection timing will be at a value which is optimum for engine performance below the maximum speed.

Figure 2:
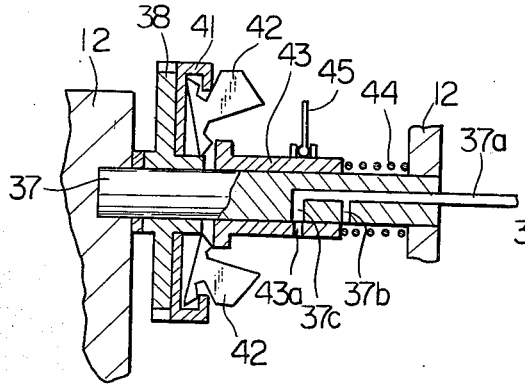
FIG. 2 is a fragmentary schematic view of the fuel injection apparatus illustrating operation at an engine speed above a predetermined value.

However, as the engine speed exceeds the maximum value, the sleeve 43 is moved rightwardly by the flyweights 42 to the position of FIG. 2 in which the radial passageway 37*b* is still unblocked but the hole 43*a* in the sleeve 43 aligns with the radial passageway 37*c* thereby opening the same to the interior chamber 12*a*. As a result, fuel flows to the conduit 16 from the interior chamber 12*a* through both radial passageways 37*b* and 37*c*. Since the flow rate is increased, the fuel pressure in the interior chamber 12*a* is reduced. With the pressure on the piston 46*b* reduced, the spring 46*d* moves the arm 48 and coupler 33 leftwardly to a new equilibrium position at which the injection timing is retarded. This retardation of injection timing reduces the formation of carbon monoxide and other pollutants formed through incomplete combustion.

Figure 3:
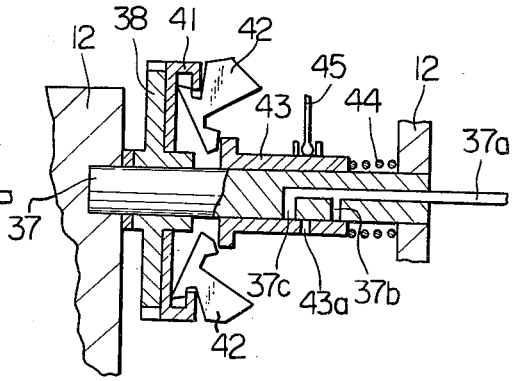
FIG. 3 is similar to FIG. 2 but illustrates operation of the fuel injection apparatus at an engine speed above a higher predetermined value.

If the engine load is light, the engine speed will further overshoot the maximum value so that the sleeve 43 is moved further rightwardly to the position shown in FIG. 3. As is clearly visible in the drawing, the right end portion of the sleeve 43 extends over the opening of the radial passageway 37*b* thereby blocking the same. In addition, the hole 43*a* in the sleeve 43 is positioned rightwardly out of alignment with the radial passageway 37*c* so that the same is blocked by the sleeve 43. As the result, no fuel is allowed to flow to the conduit 16 through the longitudinal passageway 37*a* and the pressure in the interior chamber 12*a* increases to a value close to the pressure at the outlet 13*b* of the supply pump 13.

This increase in pressure urges the piston 46*b*, arm 48 and coupler 33 rightwardly against the force of the spring 46*d* thereby causing the injection timing to be advanced beyond the value corresponding to FIG. 1. This prevents the formation of nitrogen oxides which would result through excessive combustion temperature. As the engine speed is reduced below the maximum value through the action of the sleeves 43 and 29, the injection timing is restored to the value of FIG. 1 after being again retarded to the value of FIG. 2 in a manner exactly opposite to that described above.

In summary, it will be seen that the present fuel injection apparatus prevents pollutant emission by retarding and subsequently advancing the fuel injection timing in an optimum manner as the engine speed exceeds the maximum control value and the fuel injection volume is reduced to reduce the engine speed below the maximum value. As the injection timing is controlled through modulation of the pressure of fuel supplied to the injection mechanism in accordance with the present invention, the modulator valve arrangement may be modified to provide any desired injection timing control function in accordance with engine speed. Many other modifications will become possible for those skilled in the art after receiving the teachings of the present disclosure without departing from the scope thereof.

What is claimed is:

1. A fuel injection apparatus comprising:

fuel injector means;

a rotary input member;

fuel injector control means connected between the input member and the fuel injector means for controlling a fuel injection volume in accordance with a rotational speed of the input member;

a fuel supply pump for supplying fuel to the fuel injector means;

fuel injection timing means connected to the fuel injector means for controlling a fuel injection timing in accordance with a pressure of fuel supplied to the fuel injector means from the fuel supply pump;

modulator valve means connected to the fuel injector control means and the fuel supply pump for modulating said pressure in accordance with said rotational speed of the input member;

the modulator valve means being constructed to maintain said timing at a predetermined value as said rotational speed is progressively increased from zero to a predetermined speed, and to retard said timing below said predetermined value and subsequently to advance said timing above said predetermined value as said rotational speed is progressively increased above said predetermined speed; and a fuel reservoir communicating with an inlet of the fuel supply pump, an outlet of the fuel supply pump being connected to the fuel injector means, the modulator valve means controlling communication between the outlet of the fuel supply pump and the fuel reservoir;

the modulator valve means comprising a first member formed with a passageway having at least one orifice, the passageway communicating with the fuel reservoir, said at least one orifice being communicable with the outlet of the fuel supply pump, the modulator valve means further comprising a second member movable relative to the first member for blocking and unblocking said at least one orifice, the fuel injector control means positioning the second member relative to the first member;

the first member being formed with two orifices, the second member being constructed to unblock the first orifice while blocking the second orifice, subsequently unblock both the first orifice and the second orifice and subsequently block both the first orifice and the second orifice as said rotational speed of the input member is progressively increased from zero.

2. A fuel injection apparatus comprising:

fuel injector means;

a rotary input member;

fuel injector control means connected between the input member and the fuel injector means for controlling a fuel injection volume in accordance with a rotational speed of the input member;

a fuel supply pump for supplying fuel to the fuel injector means;

fuel injection timing means connected to the fuel injector means for controlling a fuel injection timing in accordance with a pressure of fuel supplied to the fuel injector means from the fuel supply pump;

modulator valve means connected to the fuel injector control means and the fuel supply pump for modulating said pressure in accordance with said rotational speed of the input member; and a fuel reservoir communicating with an inlet of the fuel supply pump, an outlet of the fuel supply pump being connected to the fuel injector means, the modulator valve means controlling communication between the outlet of the fuel supply pump and the fuel reservoir;

the modulator valve means comprising a first member formed with a passageway having at least one orifice, the passageway communicating with the fuel reservoir, said at least one orifice being communicable with the outlet of the fuel supply pump, the modulator valve means further comprising a second member movable relative to the first member for blocking and unblocking said at least one orifice, the fuel injector control means positioning the second member relative to the first member;

the first member being formed with two orifices, the second member being constructed to unblock the first orifice while blocking the second orifice, subsequently unblock both the first orifice and the second orifice and subsequently block both the first orifice and the second orifice as said rotational speed of the input member is progressively increased from zero.

3. An apparatus as in claim 2, in which the fuel injector control means comprises a flyweight assembly.

4. An apparatus as in claim 2, in which the fuel injector means comprises a fuel injection pump including a pump housing formed with a bore and a piston reciprocatingly sealingly slidable in the bore for fuel injection, the fuel injector control means comprising fuel injector valve means provided to the injection pump.

5. An apparatus as in claim 4, in which the fuel injector means further comprises a rotary cam to reciprocate the piston for fuel injection, the cam being rotatingly driven by the input member, the fuel injection timing means connecting the cam to the input member and being constructed to control an angular position of the cam relative to the input member in accordance with said pressure.

6. An apparatus as in claim 5, in which the fuel injection timing means comprises a coupler connecting the cam to the input member, the coupler being so constructed that longitudinal movement of the coupler causes rotation of the cam relative to the input member, the fuel injection timing means further comprising pressure piston means for longitudinally positioning the coupler in accordance with said pressure.

7. An apparatus as in claim 2, in which the first member comprises a fixed shaft, the passageway comprises a longitudinal passageway formed through the shaft and the first and second orifices comprise first and second longitudinally spaced radial passageways respectively formed through the shaft, the second member comprising a sleeve sealingly slidable on the shaft and being formed with a hole alignable with the second radial passageway.

* * * * *